United States Patent [19]

Ayres

[11] Patent Number: 4,834,785

[45] Date of Patent: May 30, 1989

[54] CRYOGENIC NITROGEN GENERATOR WITH NITROGEN EXPANDER

[75] Inventor: Calvin L. Ayres, New Tripoli, Pa.

[73] Assignee: Air Products and Chemicals, Inc., Allentown, Pa.

[21] Appl. No.: 209,460

[22] Filed: Jun. 20, 1988

[51] Int. Cl.[4] ..... F25J 3/00

[52] U.S. Cl. ..... 62/38; 62/33

[58] Field of Search ..... 62/9, 11, 17, 20, 23, 62/24, 32, 33, 36, 38, 39, 42

[56] References Cited

U.S. PATENT DOCUMENTS

| | | | |
|---|---|---|---|
| 3,217,502 | 11/1965 | Keith, Jr. | 62/13 |
| 3,492,828 | 2/1970 | Ruckborn | 62/13 |
| 3,735,599 | 5/1973 | Izumichi et al. | 62/21 |
| 3,736,762 | 6/1973 | Toyama et al. | 62/13 |
| 3,886,758 | 6/1975 | Perrotin et al. | 62/39 X |
| 4,222,756 | 9/1980 | Thorogood | 62/13 |
| 4,299,607 | 11/1981 | Okabe et al. | 62/39 X |
| 4,400,188 | 8/1983 | Patel et al. | 62/39 X |
| 4,530,708 | 7/1985 | Nakazato et al. | 62/13 |
| 4,696,689 | 9/1987 | Morii et al. | 62/32 |
| 4,698,079 | 10/1987 | Yoshiho | 62/32 X |

OTHER PUBLICATIONS

"Air Separation Plant Design", D. J. Hersh et al., Cryogenics, Jul. 1977, pp. 383–390.

"Oxygen Facility for Synthetic Fuel Projects", W. J. Sharle & K. B. Wilson, ASME, Aug. 1980, pp. 1–8.

*Primary Examiner*—Steven E. Warner

*Attorney, Agent, or Firm*—Willard Jones, II; James C. Simmons; William F. Marsh

[57] ABSTRACT

The present invention is an improvement to a conventional, single column, cryogenic, nitrogen generator which is able to produce nitrogen at near atmospheric pressure. In the improvement, the product nitrogen from the rectifier column is expanded through an expansion turbine to produce refrigeration for the process. Expanding the nitrogen makes it possible for the main air compressor to operate at a much lower pressure and achieve a significant reduction in compression power as compared to conventional waste expander and air expander cycles.

5 Claims, 1 Drawing Sheet

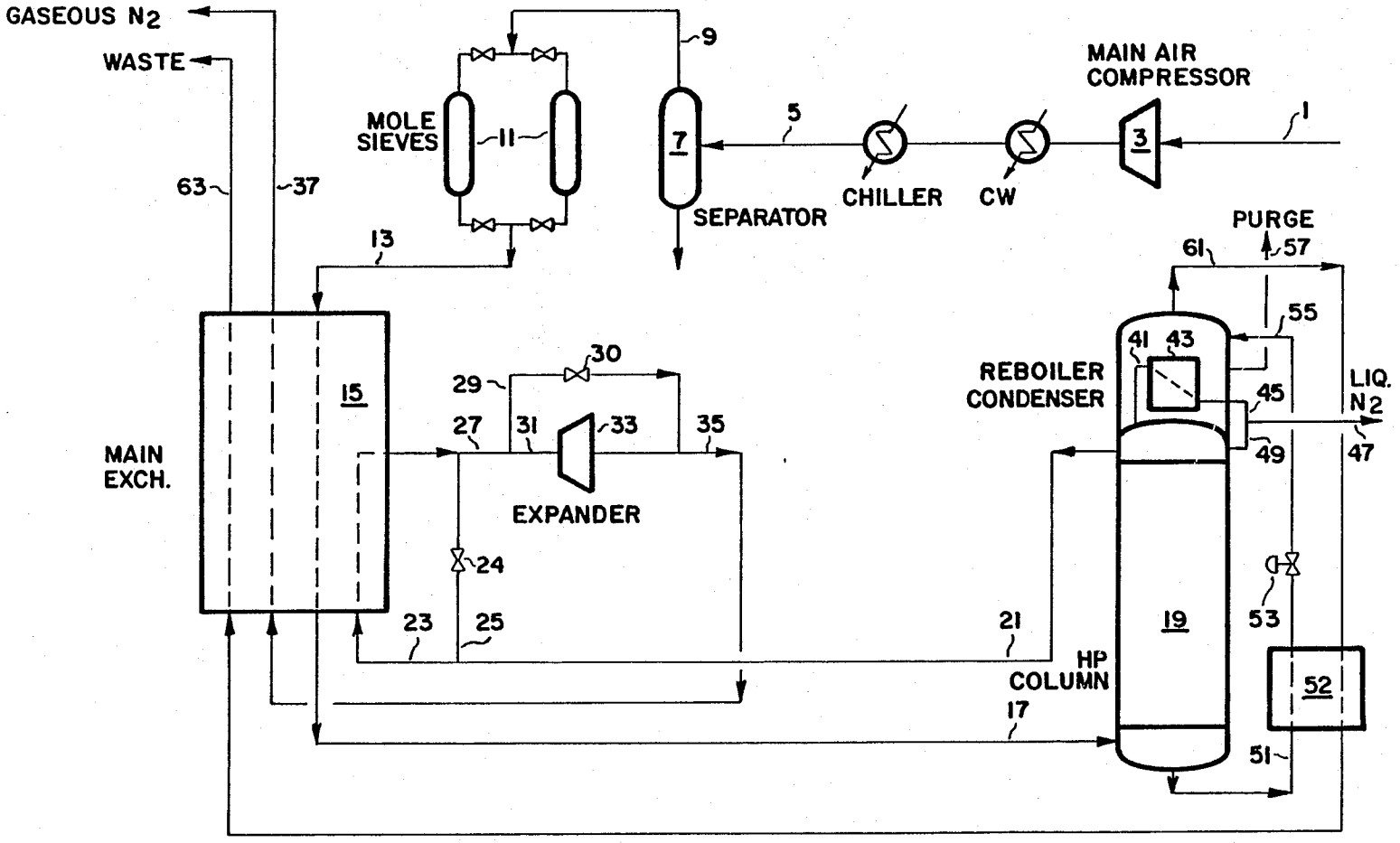
MAIN AIR COMPRESSOR
CW
CHILLER
SEPARATOR
MOLE SIEVES
EXPANDER
REBOILER CONDENSER
HP COLUMN
PURGE
LIQ. N2
MAIN EXCH.
WASTE
GASEOUS N2
1
3
5
7
9
11
13
15
17
19
21
23
24
25
27
29
30
31
33
35
37
41
43
45
47
49
51
52
53
55
57
61
63

CRYOGENIC NITROGEN GENERATOR WITH NITROGEN EXPANDER

TECHNICAL FIELD

The present invention relates to a cryogenic distillation process for the production of nitrogen. More specifically, the present invention relates to a nitrogen expansion cycle for provision of refrigeration to process.

BACKGROUND OF THE INVENTION

Numerous cryogenic distillation processes for the production of nitrogen are known in the art, among these are the following:

U.S. Pat. No. 3,217,502 discloses a process in which feed air is introduced at a higher pressure than is usual for nitrogen generators and in which, after the recovery of nitrogen, the entire quantity of oxygen rich air is expanded to produce the necessary refrigeration for the process. The patent further discloses that by the use of reversing heat exchangers and a multiple pressure fractionator, a high purity, high pressure nitrogen product is available without further compression or other refrigeration sources.

U.S. Pat. No. 3,492,828 discloses a process for the low temperature separation of a raw gas mixture containing one higher boiling component. In the process, the required refrigeration is produced in a refrigeration cycle and the higher boiling component is condensed during cooling of the raw gas and is subsequently removed from the plant together with the impure separation product to be warmed. Heat exchange in the process is carried out between the raw gas and the separation product and in the refrigeration cycle, between the compressed cycle gas and the expanded cycle gas in at least one plate-fin heat exchanger.

U.S. Pat. No. 3,735,599 discloses an air separation apparatus which comprises a reversing heat exchanger, an air liquefier, a single column rectifier provided with a condenser-evaporator and a cold generation device. In this apparatus, air is cooled in the reversing heat exchanger and liquefied in the air liquefier, the liquefied air is rectified in the single column rectifier to separate into liquid air abundantly containing oxygen and highly pure nitrogen gas. The liquid air is subjected to heat exchange in the condenser-evaporator. The resulting gasified air is subjected to heat exchange in the air liquefier and sent through the reversing heat exchanger to the cold generation device. The resultant liquefied air is sent through the air liquefier and the reversing heat exchanger to release. The patent also discloses a process for controlling the separation of cold which is characterized in that a by-pass channel is provided for communicating a position on a passage between the condenser-evaporator and the air liquefier and a position on a passage between the cold generation device and the air liquefier. A control valve is provided on the by-pass channel and the opening degree of the control valve is automatically controlled so as to regulate appropriately the flow volume of the gaseous air passing through the by-pass channel whereby the level of the liquid air in the condenser-evaporator is kept constant and the rectification of the liquefied air in the single column rectifier is carried out under stable conditions.

U.S. Pat. No. 3,736,762 discloses a method of producing gaseous and liquefied nitrogen having a pressure higher than atmospheric pressure, by the use of an apparatus comprising a reversible heat exchanger and a single column rectifier. In the process, impure gas obtained by heat-exchanging, in a condenser-evaporator, of liquefied air with nitrogen gas, each of which has been separated in the column, is divided into two parts. One of these parts is again divided into two parts; one part of this second division is passed through a control valve and then through the heat exchanger, after which it is united and admixed with the remaining part of the gas resulting from the second division, which has passed through a control valve. This admixture is supplied to an expansion turbine; the expanded impure gas is united and admixed with the remaining part of the gas resulting from the original division, which has passed through a control valve. This admixture, after having been passed through the air-liquefier and then the heat exchanger, is removed from the apparatus.

U.S. Pat. No. 4,222,756 discloses a process for producing nitrogen which comprises removing all or substantially all carbon dioxide and water vapor from air and introducing said air at between 85 and 125 psia and below −260° F., into a first distillation column. At least part of the overhead product from said first distillation column is expanded in an expander to a pressure in the range of 45 to 70 psia and at least part of the bottoms product from said first distillation column is expanded to a pressure in the range 45 to 70 psia. At least part of both expanded products are introduced into a second distillation column. A part of the refrigeration contained in the bottoms product of said second distillation column is used to provide reflux in said first distillation column. At least a part of the bottoms product from said second distillation column is expanded to a pressure equal to or less than 30 psia. A part of the refrigeration therein is used to provide reflux in said second distillation column. Nitrogen product is removed from the top of said second distillation column. The patent also discloses an apparatus for carrying out the process.

U.S. Pat. No. 4,530,708 discloses an air separation method and apparatus for liquefying and separating feed air into oxygen and nitrogen by use of a single rectification column. The temperature of the feed air, which is liquefied, is reduced to the temperature necessary for the condensation and liquefaction of pure vaporous nitrogen inside the single rectification column and is used to condense and liquefy the pure vaporous nitrogen and vaporize the feed air. After the pressure of the feed air thus vaporized is raised to the pressure necessary for the condensation and liquefaction of the pure vaporous nitrogen inside the single rectification column, the vaporized feed air is introduced into the single rectification column so that pure gaseous nitrogen can be withdrawn from the top of the single rectification column, pure gaseous oxygen from a lower portion of the column and waste gas rich in nitrogen from an intermediate portion of the column. Thus, the present invention makes it possible to carry out air separation with a high rate of recovery of oxygen using a single rectification column.

SUMMARY OF THE INVENTION

The present invention is an improvement to a process for the production of nitrogen by the cryogenic distillation of air in a single rectifier column. In the process, a feed air stream is compressed, has had impurities removed which will freeze at cryogenic temperatures, is cooled to near the dew point of the feed air and is fed to the single distillation column. In the single rectifier, the feed air stream is rectified and separated into a nitrogen overhead and a bottoms liquid enriched with oxygen.

In the improvement in its broadest sense, which is for providing refrigeration to the process, at least a portion of the nitrogen overhead is removed from the single rectifier and warmed in heat exchange with the compressed feed air stream. At least a major portion of this warmed, nitrogen overhead is expanded to recover energy and warmed in heat exchange against the compressed feed air stream.

In the improvement for the specific embodiment shown in the single figure of the drawing, at least a portion of the nitrogen overhead is removed from the single rectifier and subsequently divided into a first and second substream. The first substream is warmed in heat exchange with the compressed feed air stream; the two substreams are reunited into a combined nitrogen stream. This combined nitrogen stream is then divided into a major and minor portion. The major portion is expanded to recover energy, while the pressure of the minor portion is reduced. These two portions are recombined into a nitrogen product stream. The nitrogen product stream is warmed in heat exchange against the compressed feed air stream and recovered as nitrogen product.

BRIEF DESCRIPTION OF THE DRAWING

The single figure of the drawing is a schematic diagram of an embodiment of the present invention.

DETAILED DESCRIPTION OF THE INVENTION

There are many small tonnage uses of nitrogen which require the nitrogen product to be at pressures only slightly above atmospheric. In the past, waste expander or air expander nitrogen generator cycles have been used to produce tonnage nitrogen product; the nitrogen product from these cycles is produced at elevated pressures. The pressure of these nitrogen products was then reduced across a control valve to meet the use pressure requirement; this pressure let down (reduction) is a process inefficiency which wastes energy.

A waste expander nitrogen generator cycle is probably the most commonly used process for small nitrogen generators (less than 500 MSCFH). This process expands the waste oxygen rich stream from the reboiler/condenser to provide refrigeration for the process. The minimum nitrogen product pressure is about 62 psig which is set by the minimum refrigeration available to operate the process.

An air expander nitrogen generator cycle is also commonly used for small nitrogen generators and is more efficient than the waste expander cycle for low pressure applications. The minimum nitrogen product pressure is about 25 psig for this cycle.

Unfortunately, these processes are not energy efficient when the nitrogen product is required at pressures below the above-referenced pressures. Therefore, there is a need for an energy efficient process which will produce nitrogen at pressures only slightly above atmospheric pressure. The process of the present invention answers this need.

The present invention is an improvement to a conventional, single column, cryogenic, nitrogen generator which is able to produce nitrogen at near atmospheric pressure. In the improvement, the product nitrogen from the distillation column is expanded through an expansion turbine to produce refrigeration for the process. The expanding nitrogen makes it possible for the main air compressor to operate at a much lower pressure and achieve a significant reduction in compression power as compared to conventional waste expander and air expander cycles.

The present invention is best understood with reference to the preferred embodiment thereof. The single figure of the drawing shows the preferred version of the process.

With reference to FIG. 1, filtered feed air, introduced into the process via line 1, is compressed in compressor 3 and cooled to cooling water temperatures in an aftercooler and is further cooled to about 40° F. in a chiller unit to condense out water in the feed air. This cooled, compressed feed air, in line 5, is then fed to separator 7, wherein condensed water is removed. The feed air is removed from separator 7, via line 9, and fed through mole seive adsorbers 11 to remove the remaining water, carbon dioxide, and trace hydrocarbon contaminates.

This cooled, dried, compressed feed air is fed to main exchanger 15 via line 13, wherein it is cooled to near its dew point temperature prior to being fed to rectifier 19 via line 17. In rectifier 19, the feed air is rectified and separated to produce a pure nitrogen overhead and an oxygen-rich bottoms liquid. The overhead nitrogen is removed from rectifier 19 via two streams. The first portion of the overhead is removed via line 41 and is fed to condenser 43 wherein it is condensed. The condensed nitrogen overhead is removed from condenser 43 via line 45 and is then subsequently split into two parts. The first part is removed as liquid nitrogen product via line 47. The second part is recycled to the top of rectifier 19 via line 49 to provide reflux for rectifier 19.

The second portion of the overhead, which eventually becomes the nitrogen product stream, is removed via line 21. In order to recover the maximum refrigeration from the second portion of the overhead, stream 21 is split into two substreams; the relative proportions of the two substreams are controlled by control valve 24. First substream 23 is warmed in heat exchanger 15. Second substream 25 bypasses heat exchanger 15, is slightly reduced in pressure and recombined with warmed substream 23 to form recombined nitrogen stream 27. This recombined nitrogen stream 27 is also split into two substreams; the relative proportions of the two substreams are controlled by control valve 30. First substream 29, the minor portion, is reduced in pressure. Second substream 31, the major portion, is expanded in expander 33 and recombined with reduced pressure first substream 29 in line 35. This recombined stream in line 35 is warmed in main heat exchanger 15 and removed as gaseous nitrogen product in line 37.

Basically, the purpose of control valves 24 and 30 are to control the flow rates of the secondary flows in order to match refrigeration need with refrigeration make. When, however, valve 30 is closed (i.e., maximum refrigeration production) valve 24 provides a means for optimizing the cooling curves to obtain the most efficient means of refrigeration production.

The bottoms liquid of rectifier 19 is removed from the column via line 51, flashed across valve 53 and fed to the sump surrounding condenser 43 wherein it is vaporized. Optionally, the bottoms liquid in line 51 could be subcooled in heat exchanger (subcooler) 52 prior to flashing across valve 53, thereby reducing the vapor generated during the flashing of the bottoms liquid. In order to prevent the buildup of hydrocarbons in the sump surrounding condenser 43, a small liquid purge stream is removed via line 57. A gaseous oxygen-rich stream is removed via line 61 from the overhead of the sump surrounding condenser 43. This waste stream, in line 61, is warmed in heat exchanger 15 and, optionally, subcooler 52 to recover refrigeration and is vented to the atmosphere via line 63 as waste.

As can be seen, the operation of the process is very similar to the operation of a waste expander cycle except that the product nitrogen stream is expanded for process refrigeration instead of the waste oxygen stream.

The process can be operated with back pressure on the waste stream so that it can be withdrawn at a pressure slightly above atmospheric and used a a low purity oxygen source without the need of added compression equipment. Adding back pressure will increase the required operating power but will also increase the available refrigeration by increasing the pressure ratio across the expander.

In order to demonstrate the efficacy of the process of the present invention, the process as depicted in the single figure of the drawing was computer simulated. Table I details some results of this simulation, in particular, it lists the flow rates and stream operating conditions.

TABLE I

STREAM FLOW RATES AND PROCESS CONDITIONS FOR SELECTED STREAMS

| Stream Number | Phase | Temp °F. | Pres psia | Stream Flow Rates: # mol/hr Total | $N_2$ | Ar | $O_2$ |
|---|---|---|---|---|---|---|---|
| 5 | VAP | 40.0 | 52.8 | 100.00 | 78.12 | 0.93 | 20.95 |
| 13 | VAP | 45.0 | 50.8 | 100.00 | 78.12 | 0.93 | 20.95 |
| 17 | TOTAL | −291.8 | 48.4 | 100.00 | 78.12 | 0.93 | 20.95 |
| | VAP | | | 96.92 | 76.39 | 0.89 | 19.64 |
| | LIQ | | | 3.08 | 1.73 | 0.04 | 1.31 |
| 21 | VAP | −300.1 | 46.3 | 49.46 | 49.43 | 0.03 | 0.00 |
| 23 | VAP | −300.2 | 46.1 | 10.00 | 9.99 | 0.01 | 0.00 |
| 25 | VAP | −300.2 | 46.1 | 39.46 | 39.43 | 0.03 | 0.00 |
| 27 | VAP | −277.0 | 44.9 | 49.46 | 49.43 | 0.03 | 0.00 |
| 29 | VAP | −277.0 | 44.9 | 7.49 | 7.49 | 0.00 | 0.00 |
| 31 | VAP | −277.1 | 44.9 | 41.97 | 41.94 | 0.03 | 0.00 |
| 35 | VAP | −306.0 | 19.9 | 49.46 | 49.43 | 0.03 | 0.00 |
| 37 | VAP | 39.1 | 17.0 | 49.46 | 49.43 | 0.03 | 0.00 |
| 47 | LIQ | −300.2 | 46.1 | 0.44 | 0.44 | 0.00 | 0.00 |
| 51 | LIQ | −291.9 | 48.4 | 50.10 | 28.25 | 0.90 | 20.95 |
| 57 | LIQ | −307.6 | 17.3 | 0.20 | 0.07 | 0.00 | 0.13 |
| 61 | VAP | −304.4 | 17.3 | 49.90 | 28.18 | 0.90 | 20.82 |
| 63 | VAP | 39.1 | 14.4 | 49.90 | 28.18 | 0.90 | 20.82 |

As mentioned earlier, the present invention is an energy efficient process for the production of nitrogen at low pressures. The process of the present invention saves about twenty two percent (22%) of the operating power required by an air expander cycle for those applications where the nitrogen is required at low pressures (less than 10 psig) and is about forty three percent (43%) lower in power than a waste expander cycle producing nitrogen at 62 psig.

In order to better demonstrate this energy efficiency, Table II is provided below. Table II summarizes the major flows and operating pressures for the waste expander cycle, the air expander cycle and the nitrogen expander cycle:

TABLE II

COMPARISON OF NITROGEN GENERATORS USING DIFFERENT EXPANDER CYCLES FOR REFRIGERATION

| | Waste Exp. Cycle | Air Exp. Cycle | $N_2$ Exp. Cycle |
|---|---|---|---|
| Nitrogen recovery (% of inlet air recovered as Nitrogen) | 45.81 | 49.45 | 49.45 |
| Nitrogen Product pressure, psia | 76.40 | 39.40 | 17.00 |
| Press. at top of column: psia | 79.89 | 46.14 | 46.14 |
| Reboiler pressure: psia | 35.91 | 17.25 | 17.25 |
| Atmospheric pressure: psia | 14.40 | 14.40 | 14.40 |
| Expander flow (as % of inlet air flow) | 53.61 | 100.00 | 41.97 |
| Expander inlet pressure: psia | 33.86 | 72.00 | 44.89 |
| Expander outlet pressure: psia | 17.67 | 48.50 | 19.85 |
| Main Air Comp. Disch. P.: psia | 87.00 | 76.00 | 56.00 |
| Isothermal Main Air Compressor power to produce 100 SCFH of $N_2$ (KW/100 SCFH) | 0.330 | 0.282 | 0.231 |
| MAC power/$N_2$ Exp cycle MAC power | 1.429 | 1.221 | 1.000 |

Another benefit of the process of the present invention is that low purity oxygen (about 42% 02) can be produced from the process at low pressures (less 10 psig). In applications where low pressure/low purity oxygen is required, such as for combustion enrichment, the waste stream can be recovered without the need of added compression equipment. Recovering the waste stream at pressure will increase the main air compressor power as it would in both the air and waste expander cycles. However, the refrigeration potential will increase for the nitrogen expander cycle because the expansion ratio across the expander will increase. The available refrigeration for the air and waste expander cycles will be reduced as these cycles are back-pressured to recover the waste stream.

The present invention has been described with reference to a specific embodiment thereof. This embodiment should not the viewed as a limitation on the scope of the invention. Such scope should be ascertained by the following claims:

I claim:

1. In a process for the production of nitrogen by the cryogenic distillation of air in a single rectifier, wherein a feed air stream is compressed, has impurities removed which will freeze at cryogenic temperatures, is cooled to near the dew point and is fed to the single rectifier for rectification and separation of the feed air stream into a nitrogen overhead and a bottoms liquid enriched with oxygen, the improvement for providing refrigeration to the process comprises:

(a) removing at least a portion of the nitrogen overhead from the single rectifier;

(b) warming at least a portion of the removed nitrogen overhead in heat exchange with the compressed feed air stream;

(c) expanding at least a major portion of the warmed, removed nitrogen overhead to produce refrigeration;

(d) warming the expanded, nitrogen overhead in heat exchange against the compresed feed air stream; and (e) providing reflux heat duty by flashing a bottoms liquid stream removed from the bottom of the single rectifier and heat exchanging the flashed bottoms liquid stream with the remaining portion of the nitrogen overhead of the single rectifier, whereby the remaining portion of the nitrogen overhead is condensed and at least a portion of the condensed overhead is returned to the top of the single rectifier as reflux.

2. The process of claim 1 which further comprises subcooling the bottoms liquid stream prior to flashing.

3. In a process for the production of nitrogen by the cryogenic distillation of air in a single rectifier, wherein a feed air stream is compressed, has had impurities removed which will freeze at cryogenic temperatures, is cooled to near the dew point and is fed to the single rectifier for rectification and separation of the feed air stream into a nitrogen overhead and a bottoms liquid enriched with oxygen, the improvement for providing refrigeration to the process comprises:

(a) removing at least a portion of the nitrogen overhead from the single rectifier and dividing the removed portion of the nitrogen into a first and second substream;

(b) warming the first substream in heat exchange with the compressed feed air stream and combining the warmed first and second substreams into a combined nitrogen stream;

(c) dividing the combined nitrogen stream into a major and minor portion, expanding the major portion to produce refrigeration, and reducing the pressure of the minor portion; and (d) recombining the major and minor portions in a nitrogen product stream; and warming the nitrogen product stream in heat exchange against the compressed feed air stream and recovering the nitrogen product stream as nitrogen product.

4. The process of claim 3 which further comprises providing reflux heat duty by flashing a bottoms liquid stream removed from the bottom of the single rectifier and heat exchanging the flashed bottoms liquid stream with the remaining portion of the nitrogen overhead of the single rectifier, whereby the remaining portion of the nitrogen overhead is condensed and at least a portion of the condensed overhead is returned to the top of the single rectifier as reflux.

5. The process of claim 4 which further comprises subcooling the bottoms liquid stream prior to flashing.

* * * * *